US007572002B2

(12) United States Patent
Nishida

(10) Patent No.: US 7,572,002 B2
(45) Date of Patent: Aug. 11, 2009

(54) IMAGE FORMING APPARATUS AND ADJUSTING METHOD OF IMAGE FORMING APPARATUS

(75) Inventor: Hajime Nishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 410 days.

(21) Appl. No.: 11/297,590

(22) Filed: Dec. 8, 2005

(65) Prior Publication Data

US 2006/0132573 A1 Jun. 22, 2006

(30) Foreign Application Priority Data

Dec. 20, 2004 (JP) ..... 2004-367776

(51) Int. Cl.
*B41J 2/01* (2006.01)

(52) U.S. Cl. ..... 347/104; 347/101

(58) Field of Classification Search ..... 347/104, 347/8, 101, 102, 103; 400/352, 355, 351
See application file for complete search history.

(56) References Cited

U.S. PATENT DOCUMENTS 5,943,081 A * 8/1999 Uchida et al. ..... 347/104
6,626,511 B2 * 9/2003 Riou ..... 347/8
6,637,958 B2 * 10/2003 Smith ..... 400/354.3
2004/0076455 A1 * 4/2004 Fujiwara ..... 399/303

FOREIGN PATENT DOCUMENTS

| | | |
|---|---|---|
| JP | 2629230 | 4/1997 |
| JP | 11-160933 | 6/1999 |
| JP | 11-348373 | 12/1999 |
| JP | 2001-139176 | 5/2001 |
| JP | 2003-94744 | 4/2003 |

* cited by examiner

*Primary Examiner*—Manish S Shah
(74) *Attorney, Agent, or Firm*—Cooper & Dunham, LLP

(57) ABSTRACT

An image forming apparatus includes a carriage where a recording head configured to jet a liquid drop of recording liquid is provided, and a conveyance belt configured to convey a recording medium. The carriage is moved in a main scanning direction along a guide member and the recording medium is sent in a sub-scanning direction by the conveyance belt so that an image is formed on the recording medium. An adjustment plate configured to adjust an arrangement position of the conveyance belt is provided at a frame member configured to arrange the conveyance belt unit including the conveyance belt.

8 Claims, 9 Drawing Sheets

IMAGE FORMING APPARATUS AND ADJUSTING METHOD OF IMAGE FORMING APPARATUS

BACKGROUND

1. Technical Field

This disclosure generally relates to image forming apparatuses and adjusting methods of the image forming apparatuses.

2. Description of the Related Art

An inkjet recording apparatus, for example, is known as an image forming apparatus such as a printer, facsimile, copier or a multiple function processing machine of the printer, facsimile, and copier. In the above-mentioned inkjet recording apparatus, while a recording medium is conveyed, a liquid drop of recording liquid (hereinafter "ink drop") is adhered to the recording medium by using a recording head (image forming part) having a liquid jet head configured to jet the liquid drop of the recording liquid, so that image forming such as recording or printing is performed. Hereinafter, the recording medium is called a paper or transferred material. However, there is no limitation of material for the paper or the transferred material.

Meanwhile, as discussed in Japan Laid-Open Patent Application Publication No. 11-348373, an inkjet recording apparatus having the following structure is known. In this apparatus, a carriage having a recording head and a conveying belt for conveying paper are provided and a gap regulating member is vertically displaced to vertically move the conveying belt so that a gap between the conveying belt and the recording head of the carriage is regulated.

In addition, as discussed in Japanese Patent No. 2629230, a paper transport apparatus having the following structure is known as an electrophotographic image forming apparatus. In this apparatus, a paper which has caused a paper jam is surely removed in a simple operation by supporting a paper transport apparatus in such a manner as to freely turn round one lateral end of transported paper and disposing turning means for positioning and locking the paper transport apparatus at a designated angle of rotation on the other lateral end of transported paper.

Furthermore, as discussed in Japan Laid-Open Patent Application Publication No. 11-160933, an electrophotographic image forming apparatus having the following structure is known. In this apparatus, first and second side plate members of a main body are arranged opposed in parallel with and in the carrying direction of a sheet so as to interpose a carrying belt carrying the sheet along plural image forming parts arranged in parallel in the main body. Then, exposure means arranged at the respective image forming parts so as to expose image carriers arranged at the respective image forming parts are fixed to the first and the second side plate members of the main body. Besides, sheet carrying means having the belt, a driving roller obtained by laying the belt and a driven roller is fitted to the main body so as to be freely drawn out. By engaging both end parts of the carrying means in the carrying direction of the sheet with the first and the second side plate members, the carrying means is positioned and fixed to the main body.

Furthermore, as discussed in Japan Laid-Open Patent Application Publication No. 2001-139176, an image forming apparatus having the following structure is known. This image forming apparatus is characterized to be constituted so that bearing parts of a drive roller and a driven roller stretching the transfer material conveyance face of a transfer material conveyance belt are directly pressured against and engaged with fitting position reference faces formed in edge parts of side plates where the transfer material is formed of sheets.

Furthermore, as discussed in Japan Laid-Open Patent Application Publication No. 2003-94744, an inkjet printer having the following structure is known. This inkjet printer is characterized by having a printer head in a fixed position, a print paper conveyance unit configured to convey a print paper along a head surface of the printer head, a conveyance unit elevating mechanism configured to move the print paper conveyance unit up and down relative to the head surface of the printer head, and a gap adjustment device in which a gap between the print paper conveyance unit and the head surface of the printer head is adjusted.

In the image forming apparatus, like the above-mentioned ink jet recording apparatus, having a structure where the carriage having the recording head is moved for scanning and the paper is conveyed by the conveyance belt, if the gap between the recording head and the conveyance belt is not fixed, an error in the position at which the liquid drop is received is generated. Hence, gap precision between the recording head and the conveyance belt is important for forming a high quality image. Because of this, the conveyance belt and a guide rod configured to guide scanning movement of the carriage or inclination in the paper conveyance direction of the carriage should be positioned to be parallel at high precision.

In the related art inkjet recording apparatus using the conveyance belt, as discussed in Japan Laid-Open Patent Application Publications No. 11-348373 and No. 2003-94744, the gap adjustment can be done but exchanging the conveyance belt is not expected to be required.

In a case of a personal type inkjet printer for an individual, the printer can be taken to a factory for exchanging the belt. However, in a case of a multiple function processing machine including an inkjet recording apparatus for office use, it is preferable that the belt can be exchanged periodically and a service person change the belt as a consumption articles when performing maintenance near the user, so that degradation of image quality due to extension, friction and damage to the conveyance belt can be prevented.

As discussed above, it is required in the inkjet recording apparatus that the conveyance belt and a guide rod configured to guide scanning move of the carriage or inclination in the paper conveyance direction of the carriage should be positioned in parallel at high precision. However, in the related art inkjet recording apparatus, it is difficult to exchange the conveyance belt. Even if the service person exchanges the conveyance belt near the user, precision cannot be guaranteed

SUMMARY

Accordingly, in an aspect of this disclosure, a novel and useful image forming apparatus and adjusting method of the image forming apparatus are provided.

In another aspect of this disclosure an image forming apparatus and adjusting method of the image forming apparatus are provided whereby a reproducing the arrangement precision when the conveyance belt is rearranged or exchanged can be improved.

In an exemplary embodiment an image forming apparatus includes:

a carriage where a recording head configured to jet a liquid drop of recording liquid is provided; and a conveyance belt configured to convey a recording medium;

wherein the carriage is moved in a main scanning direction along a guide member and the recording medium is sent in a sub-scanning direction by the conveyance belt so that an image is formed on the recording medium; and an adjustment plate configured to adjust an arrangement position of the conveyance belt is provided at a frame member configured to arrange the conveyance belt unit including the conveyance belt.

Another adjustment plate configured to adjust a position of the guide member configured to guide the moving in the main scanning direction of the carriage may be provided at another frame member where the guide member is arranged.

The above object of the present invention is also to provide another exemplary embodiment, an image forming apparatus includes:

a carriage where a recording head configured to jet a liquid drop of recording liquid is provided; and a conveyance belt configured to convey a recording medium;

wherein the carriage is moved in a main scanning direction along a guide member and the recording medium is sent in a sub-scanning direction by the conveyance belt so that an image is formed on the recording medium; and means for adjusting an arrangement position of the conveyance belt is provided at a frame member configured to arrange a conveyance belt unit including the conveyance belt.

The means for adjusting a position of the guide member configured to guide the moving in the main scanning direction of the carriage is provided at another frame member where the guide member may be arranged.

According to the above-mentioned image forming apparatus, the adjustment plate configured to adjust the arrangement position of the conveyance belt is provided at the frame member configured to arrange the conveyance belt unit including the conveyance belt. Hence, it is possible to improve reproducing the arrangement precision when the conveyance belt is rearranged or exchanged so as to easily do maintenance of the image forming apparatus by determining the adjustment position of the adjustment plate at the time of initial assembling.

In an exemplary embodiment. an adjusting method of an image forming apparatus is provided, the image forming apparatus including a carriage where a recording head configured to jet a liquid drop of recording liquid is provided; and a conveyance belt configured to convey a recording medium;

wherein the carriage is moved in a main scanning direction along a guide member and the recording medium is sent in a sub-scanning direction by the conveyance belt so that an image is formed on the recording medium;

the method including the steps of:

providing an adjustment plate configured to adjust an arrangement position of the conveyance belt at a frame member configured to arrange a conveyance belt unit including the conveyance belt; and adjusting an arrangement position of the adjustment plate against the frame member by using a plane jig configured to form a standard plane surface.

The above-mentioned adjusting method may further include the steps of:

mounting a rod positioning jig on the plane jig, the rod positioning jig being configured to determine a height position of a guide rod configured to guide the moving in the main scanning direction of the carriage; and adjusting the arrangement position of the adjustment plate against the frame member by inserting the guide rod or a guide rod jig into the rod positioning jig.

The above-mentioned adjusting method of the image forming apparatus may further include the steps of:

arranging a rail positioning jig configured to determine an arrangement position of a guide rail configured to guide the moving in the main scanning direction of the carriage, at the rod positioning jig; and arranging a rail jig corresponding to the guide rail by corresponding to the rail positioning jig and thereby fall of the carriage is adjusted.

According to the above-mentioned adjusting method of the image forming apparatus, the adjustment plate configured to adjust the arrangement position of the conveyance belt is provided at the frame member configured to arrange the conveyance belt unit including the conveyance belt. The arrangement position of the adjustment plate against the frame member is adjusted by using the plane jig configured to form the standard plane surface. Hence, it is possible to improve reproducing the arrangement precision when the conveyance belt is rearranged or exchanged so as to easily do maintenance of the image forming apparatus by determining the adjustment position of the adjustment plate at the time of initial assembling.

Other aspects, features, and advantages of the present invention will become more apparent from the following detailed description when read in conjunction with the accompanying drawings.

DETAILED DESCRIPTION OF THE PREFERED EMBODIMENTS

A description of the present invention is now given, with reference to FIG. 1 through FIG. 11, including embodiments of the present invention.

Figure 1:
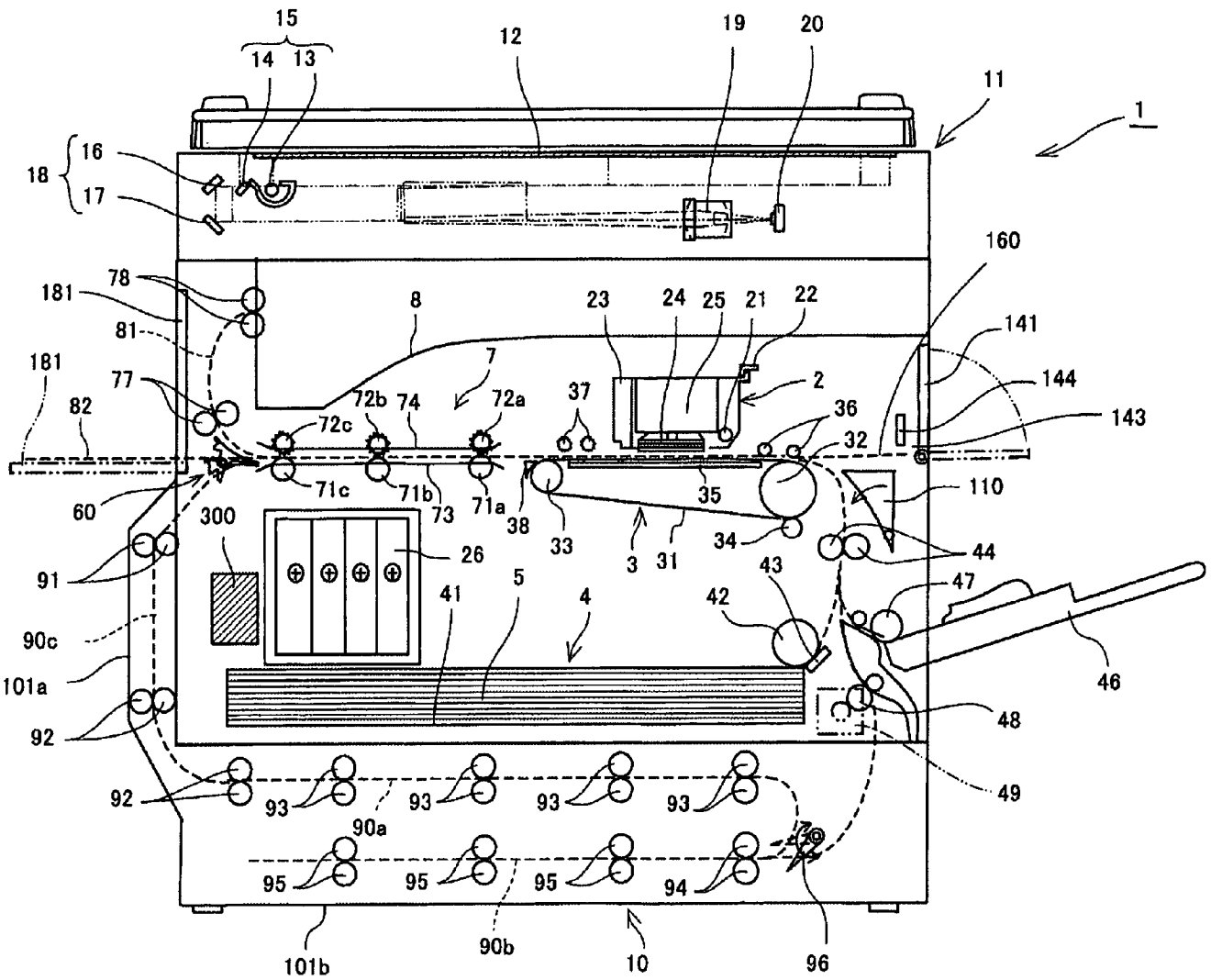
FIG. 1 is a schematic structural view showing a whole structure of an image forming apparatus of an embodiment of the present invention.
Figure 2:
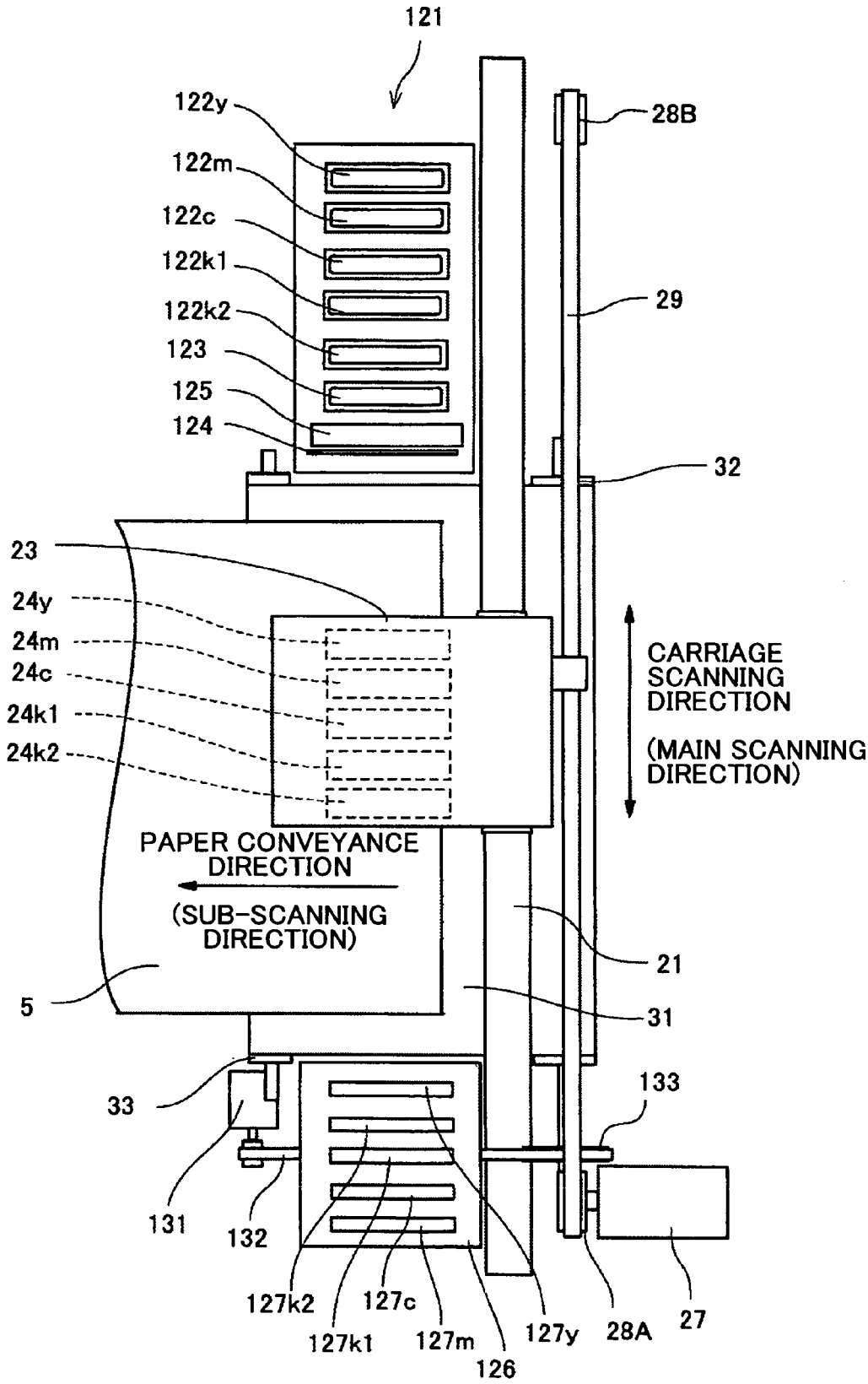
FIG. 2 is a plan view of an image forming part and a sub-scanning conveyance part of the image forming apparatus shown in FIG. 1.
Figure 3:
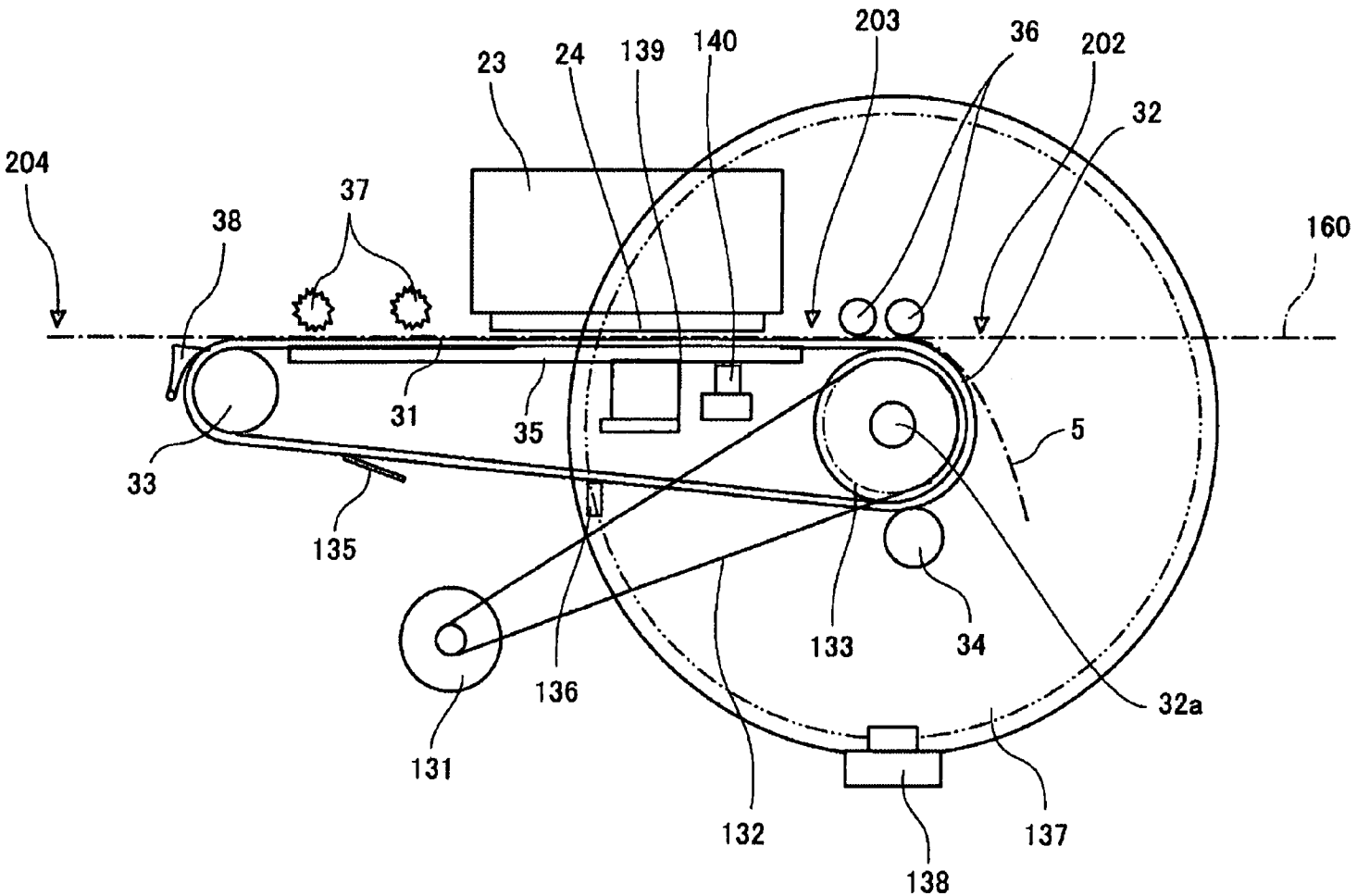
FIG. 3 is a side view of the image forming part and the sub-scanning conveyance part of the image forming apparatus shown in FIG. 1.

First, an embodiment of an image forming apparatus of the embodiment of the present invention is discussed with reference to FIG. 1 through FIG. 3. Here, FIG. 1 is a schematic structural view showing a whole structure of an image forming apparatus of an embodiment of the present invention, FIG. 2 is a plan view of an image forming part and a sub-scanning conveyance part of the image forming apparatus shown in FIG. 1, and FIG. 3 is a side view of the image forming part and the sub-scanning conveyance part of the image forming apparatus shown in FIG. 1.

The image forming apparatus has a structure where an image forming part (image forming means) 2 configured to form an image while a paper is conveyed, a sub-scanning conveyance part (sub-scanning conveyance means) 3 configured to convey the paper, and others are provided inside of an apparatus main body (housing) 1. Paper sheets 5 are fed one by one from a paper feeding part (paper feeding means) including a paper feeding cassette provided at a bottom part of the apparatus main body 1. While the paper 5 is conveyed at a position facing the image forming part 2 by the sub-scanning conveyance part 3, a liquid drop is jetted onto the paper 5 by the image forming part 2 so that an image is formed (recorded) on the paper 5. After that, in a case of one side printing, the paper 5 is discharged on a paper discharging tray 8 formed on an upper surface of the apparatus main body 1 via a paper discharge conveyance part (paper discharge conveyance means) 7. In a case of both sides printing, the paper 5 is sent from the paper discharge conveyance part 7 to a both sides unit 10 provided at the bottom part of the apparatus main body 1 so as to be switch back conveyed (reversed), so that the paper 5 is fed to the sub-scanning conveyance part 3 against so that images are formed on both sides of the paper. After that, the paper 5 is discharged on the paper discharge tray 8.

As an input system of image data (printing data) formed by the image forming part 2, the image forming apparatus includes an image reading part (scanner part) 11 configured to read the image. The image reading part is provided at an upper part of the paper discharge tray 8 situated at an upper part of the apparatus main body 1. In the image reading part 11, a scanning optical system 15 includes a lighting source 13 and a mirror 14 and a scanning optical system 18 includes mirrors 16 and 17 are moved so that the image of a manuscript provided on a contact glass 12 is read out. A scanned manuscript image is read out as an image signal by an image reading element 20 provided at the back of a lens 19. The image signal that is read out is digitalized and image-processed so that printing data that are image-processed can be printed.

This image forming apparatus has an input system of the image data (printing data) formed by the image forming part 2. The printing data and others including the image data from a host side such as an imaging apparatus like a digital camera, an image reading apparatus like an image scanner, an information processing apparatus like an outside personal computer, or the like can be received via a cable or network. The received printing data can be processed and printed.

As shown in FIG. 2, the image forming part 2 of the image forming :apparatus has a structure where a carriage 23 is held un moveably in a main scanning direction in a cantilever state by a guide rod 21 and a guide rail 22 (FIG. 1). The carriage 23 can move in the main scanning direction driven by an endless timing belt 29 wound around and tensioned between a driving pulley 28A and an idler pulley 28B and driven by a main scanning motor 27.

A recording head 24 is mounted on the carriage 23. The recording head 24 is formed by a liquid drop jet head configured to jet a liquid drop of each color. The carriage 23 is moved in a main scanning direction. While the paper 5 is intermittently sent in a paper conveyance direction (sub-scanning direction) by a sub-scanning conveyance part 3, the liquid drops are jetted from the recording head 24 which is a shuttle type head so that the image is formed. A line type head can be used as the recording head 24.

The recording head 24 includes two liquid drop jet heads 24*k*1 and 24*k*2 configured to jet black (Bk) ink, a liquid drop jet head 24*c* configured to jet cyan (C) ink, a liquid drop jet head 24*m* configured to jet magenta (M) ink, and a liquid drop jet head 24*y* configured to jet yellow (Y) ink. Color ink is supplied from respective sub tanks 25 provided in the carriage 23.

On the other hand, as shown in FIG. 1, ink cartridges 26 of respective colors can be detachably arranged from a front surface of the apparatus main body 1 to a cartridge arranging part. Black (Bk) ink, cyan (C) ink, magenta (M) ink, and yellow (Y) ink are received in the ink cartridges. Inks are supplied from the ink cartridges 26 the corresponding sub tanks 25. The black (Bk) ink is supplied from a single ink cartridge 26 to two sub tanks 25.

As the recording head 24, a piezoelectric type recording head, a thermal type recording head, an electrostatic type recording head, and others can be used. In a case of the piezoelectric type recording head, a piezoelectric element is used as pressure generation means (actuator means) for putting ink under pressure in an ink path (pressure generation room) and a vibration plate forming a wall surface of the ink path is deformed so that the volume of the ink path is changed and the ink drop is jetted. In a case of the thermal type recording head, the ink drop is jetted by pressure based bubbles generated by heating the ink in the ink path by using a heat generation resistant body. In a case of an electrostatic type recording head, a vibration plate forming a wall surface of an ink path and an electrode face each other and the vibration plate is deformed by an electrostatic force generated between the vibration plate and the electrode so that the volume of the ink path is changed and the ink drop is jetted.

In a non-printing area at one side in a scanning direction of the carriage 23, as shown in FIG. 2, a keeping and recovering apparatus 121 configured to restore and maintain a state of the nozzle of the recording head 24 is provided. The keeping and recovering apparatus 121 includes five moisture retention caps 122*k*2, 122*k*1, 122*c*, 122*m*, and 122*y*, a single suction cap 123, a wiper blade 124, a test jet receiving member 125, and others. The moisture retention caps 122 are configured to cap the nozzle surfaces of the recording heads 24. The wiper blade 124 is configured to wipe the nozzle surfaces of the recording heads 24. The test jet receiving member 125 is used for test jetting that is jetting of the liquid drops not contributing to recording (image forming).

Furthermore, in a non-printing area at another side in the scanning direction of the carriage 23, as shown in FIG. 2, a test jet receiving member 126 is provided. The test jet receiving member 126 is used for test jetting that is jetting of the liquid drop not contributing to recording (image forming) from five recording heads 24. As corresponding to the recording head 24, five openings 127*k*2, 127*k*1, 127*c*, 127*m*, and 127*y* are formed in the test jet receiving member 126.

As shown in FIG. 3, the sub-scanning conveyance part 3 includes an endless conveyance belt 31, an electrostatic charging roller 34, a guide member 35, two pressing rollers 36, two rollers 37, and a separation claw 38. The endless conveyance belt 31 is wound around a conveyance roller 32 which is a driving roller and an idler roller 33 which is a tension roller so that the conveyance direction of the paper 5 fed from a lower part is changed by about 90 degrees and the paper 5 is conveyed so as to face the image forming part 2. The electrostatic charging roller 34 is an electrostatic charging part configured to apply a high voltage that is an AC (alternating current) voltage from a high voltage electric power source so that a surface of the conveyance belt 31 is charged. The guide member 35 guides the conveyance belt 31 in an area facing the image forming part 2. The pressing roller 36 presses the paper 5 to the conveyance belt 31 at a position facing the conveyance roller 32. The roller 37 presses at an upper side of the paper 5 where the image is formed by the image forming part 2. The separation claw 38 is configured to separate the paper 5 where the image is formed from the conveyance belt 31.

The conveyance roller 32 is rotated by the sub-scanning motor 131 via a timing belt 132 and a timing roller 133, so that the conveyance belt 31 of the sub-scanning conveyance part 3 goes around in a paper conveyance direction, namely a sub-scanning direction, in FIG. 2.

The conveyance belt 31 has a double-layers structure of a surface layer and a rear surface layer. The surface layer is a paper attraction surface formed by, for example, a pure resin material where resistance control is not applied such as ETFE pure material. The rear surface layer (middle resistance layer, earth layer), where the resistance control is applied by carbon, is formed by the same material as the surface layer. However, the structure of the conveyance belt 31 is not limited the double-layered structure but may be a single layer structure or triple or more layers structure.

A cleaning part 135 such as MYLAR® film or tape and a static eliminating brush 136 are provided between the idler roller 33 and the electrostatic charging roller 34. The cleaning part 135 is configured to remove paper powder adhered to the surface of the conveyance belt 31. The static eliminating brash 136 is configured to eliminate electrical charge from the surface of the conveyance belt 31.

In addition, a code wheel 137 having a high resolution is arranged at a shaft 32*a* of the conveyance roller 32. A permeation type photo sensor 138 is provided at the code wheel 137 so as to detect a slit, not shown in FIG. 3, formed on the code wheel 137. The code wheel 137 and the photo sensor 138 form a rotary encoder.

A linear scale, not shown in FIG. 3, is formed on a surface at a rear surface side of the conveyance belt 31, namely the surface coming in contact with an external circumferential surface of the conveyance roller 32. A refection type photo sensor 139 is provided so as to read the linear scale. The linear scale and the photo sensor 139 form a liner encoder. The linear scale may be formed in strips by evaporating aluminum on the surface of the rear surface side of the conveyance belt 31 and then applying laser light. The linear scale is provided at a part where reading by the reflection type photo sensor 139 is not obstructed by the guide member 35. Neighboring to the sensor 139, a connection part sensor 140 is provided so that a connection part of the linear scale provided at the surface of the rear surface side of the conveyance belt 32 is detected.

The paper feeding part 4 includes a paper feeding cassette 41, a paper feeding roller 42, a friction pad 43, and resist rollers 44. The paper feeding cassette 41 is provided detachably from the front surface side of the apparatus main body 1 and holds a large number of the papers 5. The paper feeding roller 42 separates and sends the papers 5 provided in the paper feeding cassette 41 one by one. The fed paper 5 is restrained by the resist roller 44.

The paper feeding part 4 also includes a manual tray 46, manual roller 47, and a conveyance roller 48. The manual tray 46 also holds a large number of the papers 5. The manual roller 47 fed the papers 5 one by one from the manual tray 46. The conveyance roller 48 conveys the paper 5 fed from the paper feeding cassette optionally provided at a lower side of the apparatus main body 1 or a both-sides unit 10 discussed below. Members configured to feed the paper to the sub-scanning conveyance part 3 such as the paper feeding roller 42, the resist rollers 44, the manual roller 47, and the conveyance roller 48 are driven and rotated by the paper feeding motor 49 such as an HB type stepping motor via an electromagnetic clutch not shown.

The paper discharge conveyance part 7 includes conveyance rollers 71*a*, 71*b*, and 71*c*, rollers 72*a*, 72*b* and 72*c*, a lower guide 73, an upper guide 74, a turning-over roller couple 77, and a turning-over paper discharge roller couple 78. The conveyance rollers 71*a*, 71*b*, and 71*c* convey the paper 5 separated by the separation claw 38 of the sub-scanning conveyance part 3. The rollers 72*a*, 72*b*, and 72*c* face the conveyance rollers 71*a*, 71*b*, and 71*c*. The lower guide part 73 and the upper guide part 74 guide the paper 5 conveyed between the paper discharge roller 71 and the roller 72. A conveyance path through which the paper 5 is conveyed between the lower guide part 73 and the upper guide part 74 is called a conveyance path 70. The paper 5 between the lower guide part 73 and the upper guide part 74 is turned over via the turning-over paper discharge path 81 as a first conveyance path so that the paper 5 is sent to the paper discharge 8 face-down by the turning-over roller couple 77 and the turning-over paper discharge roller couple 78.

A branching mechanism 60 is provided at an exit side of the conveyance path 70 so that the conveyance path is switched to the first paper discharge path 81 for turning over and discharging the paper 5 to the paper discharge tray 8, the second paper discharge path 82 for discharging the paper to a straight paper discharge tray 181, or the both sides unit 10.

In the both-sides unit 10, a vertical conveyance part 101*a* and a horizontal conveyance part 101*b* are formed in a body. The vertical conveyance part 101*a* includes a vertical both sides conveyance path 90*c* through which the paper 5 is received from a side surface part of the apparatus main body 1 and conveyed to a lower part. The horizontal conveyance part 101*b* includes a switch back conveyance path 90*b* and a horizontal taking conveyance 90*a* through which the paper is conveyed in a horizontal direction following the vertical both sides conveyance path 90*c*.

A both sides entrance roller couple 91 by which the paper 5 is sent to the lower part and a conveyance roller couple 92 by which the paper 5 is sent to the horizontal taking conveyance path 90*a* are provided at the vertical both sides conveyance path 90*c*. Five both-sides conveyance roller couples 93 are provided at the horizontal talking conveyance path 90*a*. Three both-sides conveyance roller couples 95 and a both sides exit roller 94 formed by a reverse roller for turning over and re-feeding the paper 5 send through the horizontal talking conveyance path 90*a* are provided at the switch back conveyance path 90*b*.

The branching plate 96 is provided to oscillate that the conveyance path from the taking conveyance 90*a* to the switch back conveyance 90*b* and the conveyance path for re-feeding from the switch pack conveyance 90*b* to the conveyance roller couple 48 can be switched. The branching plate 96 can be oscillated between a switch back side position shown by a solid line in FIG. 1 and a re-feeding side position shown by a broken line in FIG. 1.

The paper 5 sent from the both sides unit 10 is sent to the resist roller 44 via the conveyance roller 48.

As shown in FIG. 1, an opening and closing guide plate 110 is provided to oscillate so that a back force due to the weight of the paper 5 is prevented by forming a curve in the paper 5 between the conveyance roller 32 and the pressing roller 36 and the resist roller 44 when the paper 5 fed from the paper feeding cassette 41, the manual paper feeding tray 46, or the both sides unit 10 is conveyed by the resist rollers 44.

When the paper 5 is sent from the resist rollers 44 to the sub-scanning conveyance part 3, the opening and closing guide plate 110 is oscillated in a direction shown by an arrow in FIG. 1 for guiding the paper 5. At the timing when the paper 5 reaches the sub-scanning conveyance part 3, the opening and closing guide plate 110 returns to the position shown in FIG. 1 so that the curve can be formed.

In addition, in this image forming apparatus, as shown in FIG. 1, a single paper manual paper feeding tray 141 is provided for single paper manual paper feeding. The single paper manual paper feeding tray 141 is provided at one side part of the apparatus main body 1 so as to be able to be opened and closed. When single paper manual paper feeding is performed, the single paper manual paper feeding tray 141 is opened at a position shown by a horizontal 2-dot broken line. The paper 5 which is manually fed from the single paper manual paper feeding tray 141 is guided by an upper surface of the opening and closing guide plate 110 so that the paper 5 can be linearly pushed between the conveyance roller 32 and the pressing roller 36.

On the other hand, the straight paper discharge tray 181 is provided at the opposite side part of the apparatus main body 1 so as to be able to open and close in order to discharge the paper 5 where the image is formed facing up. By opening the straight paper discharge tray 181, a straight paper discharge path 82 as a second paper discharge path is formed so that the paper 5 sent from the lower guide part 73 and the upper guide part 74 is discharged to the paper discharge conveyance part 7 straight out horizontally.

Under this structure, if a paper, such as an OHP or a paper with greater thickness, whose curving conveyance is difficult, is used, single paper manual paper feeding is performed from the single paper manual paper feeding tray 141 so that the paper 5 can be conveyed to the straight paper discharge tray 181 along a straight path. Even if the paper is has normal thickness, it is possible to feed the paper from the single paper manual paper feeding tray 141 and discharge the paper to the straight paper discharge tray 181 along the straight path.

An operation for image forming in this image forming apparatus is discussed. By applying a high voltage of a rectangular wave positive negative electrode that is an AC voltage from an AC bias supply part to an electrostatic charge roller 34, positive and negative electrical charges are reciprocally applied to the surface layer of the conveyance belt 31 in a belt shape against the conveyance direction of the conveyance belt 31 because the electrostatic charge roller 34 comes in contact with the insulation layer (surface layer) of the conveyance belt 31. As a result of this, unequal electrical fields are generated due to electric charges being generated on the conveyance belt 31 at a designated charge width.

In a case where the paper 5 is fed from the paper feeding part 4, the manual paper feeding part 46, the both-sides unit 10, or the single paper manual paper feeding tray 141 and the electric charge of the positive and negative electrode is formed between the conveyance roller 32 and the pressing roller 36 so that the paper 5 is sent to the conveyance belt 31 where unequal electric field is generated, the paper 5 is immediately polarized as following the direction of the electric field. As a result of this, the paper 5 is adhered on the conveyance belt 31 by an electrostatic attraction force so as to be conveyed by the movement of the conveyance belt 31.

While the paper 5 is conveyed intermittently by the conveyance belt 31, the liquid drops are jetted from the recording head 24 to the paper 5 as corresponding to the printing data so that the image is formed (printed). A head end side of the paper 5 where the image is formed is separated from the conveyance belt 31 by the separation claw 38. And then, the paper 5 is discharged to the paper discharge tray 8 or the straight paper discharge tray 18 by the paper discharge conveyance part 7, or sent to the both sides unit 10 and then discharged after an image is formed on the other side.

Figure 4:
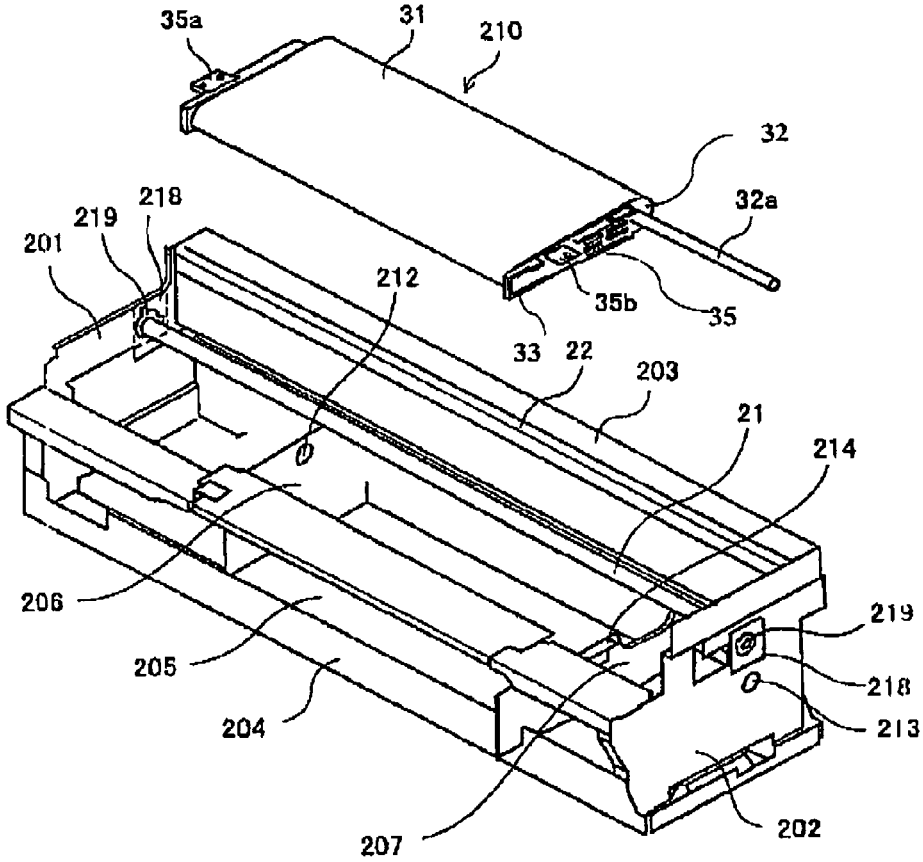
FIG. 4 is a perspective view of the image forming apparatus shown in FIG. 1 for explaining a frame structure and an arrangement structure of a conveyance belt unit.

Next, with reference to FIG. 4, adjustment of positioning (fall of the carriage) of the guide rail 22, guide rod 21, and a conveyance belt unit 210 including the conveyance belt 31 in this image forming apparatus is discussed. Although members forming a frame are shown by lines in FIG. 4, the members actually have thicknesses (widths).

The structure of the frame of this image forming apparatus includes left and right (rear and front) side plates 201 and 202, a front plate 203, a rear plate 204 and a bottom plate 205 which bridge between the side plates 201 and 202, and sub side plates 206 and 207 between the side plates 201 and 202. Although theses members 201 through 207 forming the frame are formed by a single or plural plate member(s), illustration thereof is omitted.

Here, the guide rod 21 bridges between the side plates 201 and 202 so as to guide the moving scan of the carriage 23. The guide rail 22 is arranged at the front plate 203 so as to guide the moving scan of the carriage 23. The ends of the guide rod 21 are supported at corresponding holders 219 rotatably supported by rod adjustment plates 218 fixed to the side plates 201 and 202 by fixing members such as screws.

As shown in FIG. 4, the conveyance belt unit 210 including the conveyance belt 31, the conveyance roller 32, the idler roller 33, and the guide member 35 is provided between the sub side plates 206 and 207. The end parts of a shaft 32*a* of the conveyance roller 32 are rotatably supported at corresponding piercing holes 212 and 213 of the sub side plate 206 and the side plate 202, respectively, via bearings.

Figure 5:
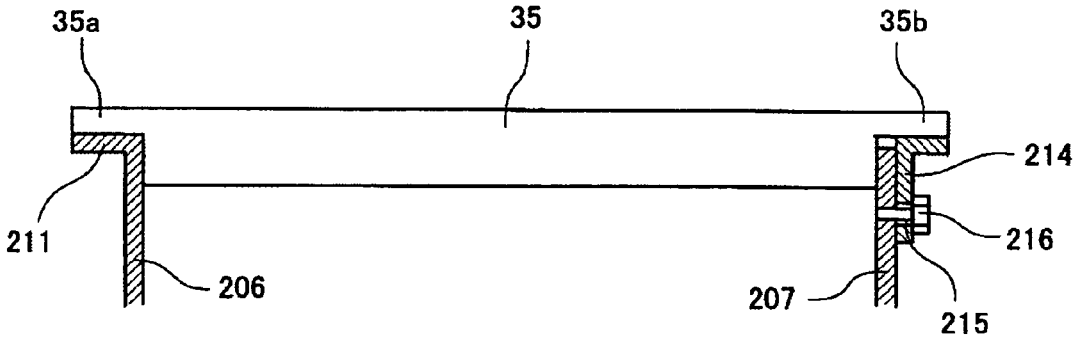
FIG. 5 is a view for explaining an arrangement state of an adjustment plate to a sub side plate.
Figure 6:
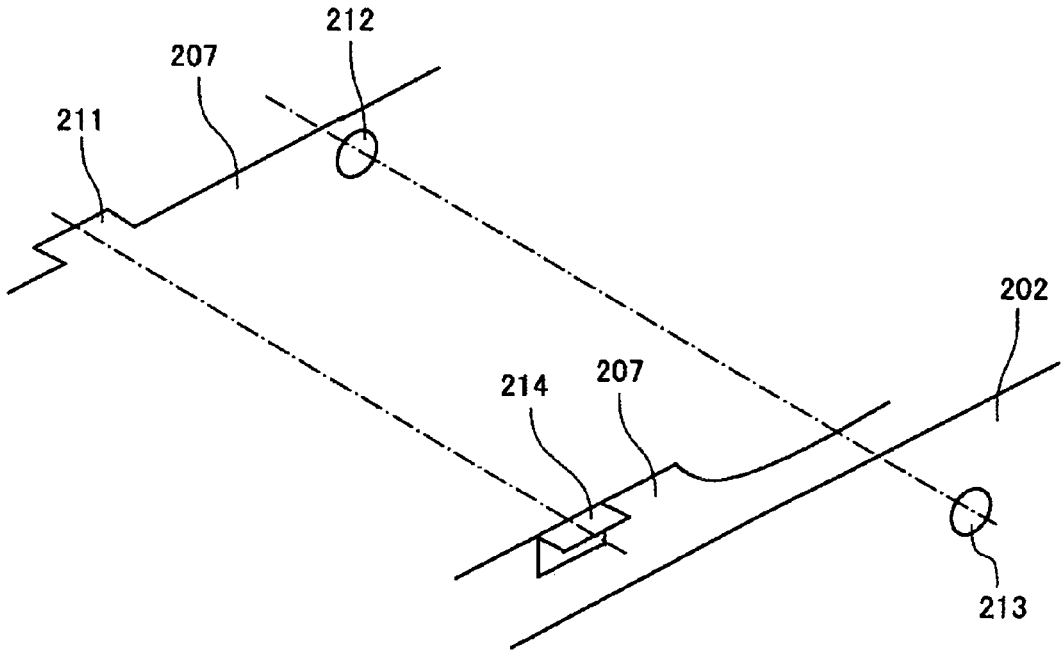
FIG. 6 is a schematic perspective view of a side plate and a holding part of the conveyance belt unit.

The arrangement of the conveyance belt 31 of the conveyance unit 210 in relation to the frame is discussed with reference to FIG. 5 and FIG. 6. FIG. 5 is a view for explaining the arrangement of an adjustment plate to a sub side plate. FIG. 6 is a schematic perspective view of a side plate and a holding part of the conveyance belt unit.

The conveyance belt unit 210 has the following structure. A flange part 35*a* formed at an end of the guide member 35 is fixed by screws to a substantially L shaped supporting member 211 formed in a body with or separately from the sub side plate 206. A bearing (not shown) rotatably supporting one end of the shaft 32*a* of the conveyance roller 32 is fixed to the piercing hole 212 formed in the sub side plate 206. A bearing (not shown) rotatably supporting the other end of the shaft 32*a* of the conveyance roller 32 is fixed to the piercing hole 213 formed in the side plate 202.

A flange part 35*b* formed at the other end of the guide member 35 is fixed by screws to a substantially L shaped supporting member 214 formed so that the height position is adjustable. The position in height directions of the adjustment plate 214 against the sub side plate 207 which is a frame member is adjustably provided by screwing a screw 216 into the sub side plate 207 via a hole 215 elongated in upper and lower directions of the adjustment plate 214.

Thus, the conveyance belt unit 210 is supported at four points. A position adjustment can be made by the adjusting plate 214 at one of the four points. Under this structure, the conveyance belt 210 including the conveyance belt 31 can be supported by the sub side plates 206 and 207 and the side plate 202 which are frame members where a plane surface state of the conveyance belt 31 is maintained. In addition, even in a case where the conveyance belt 31 is removed or exchanged, the plane surface state can be maintained or reproduced.

That is, in a case where the conveyance belt unit 210 is supported at four points, if all four points are directly fixed to the sub side plates 206 and 207 and the side plate 202, torsion or strain is generated at the conveyance belt unit 210 and therefore it is difficult to attain the plane surface state. In addition, the strain generated at the sub side plates 206 and 207 and the side plate 202 may cause a bad influence, so that even if a jig is used for producing the plane surface state at the time of the initial assembling, it is difficult to reproduce the plane surface state once it is removed.

On the other hand, in a case where three points are directly attached to the sub side plates 206 and 207 and the side plate 202, torsion or strain may not be generated at the conveyance belt unit 210. After three points are fixed so that a plane surface is obtained, the adjustment position of the adjustment plate 214, whose position can be adjusted as corresponding to the position of the conveyance belt unit 210 having a plane surface is adjusted at the other point so that torsion or strain is not generated at the conveyance belt unit 210. Therefore even if the conveyance belt 31 is removed or exchanged, a plane surface can be reproduced at the time of reassembling or exchanging.

Because of this, even if the special jig is not used for making a plane surface at the time of the initial assembling and even if the belt 31 is exchanged near the user, it is possible to reproduce the plane surface so that high maintenance ability can be obtained.

Figure 7:
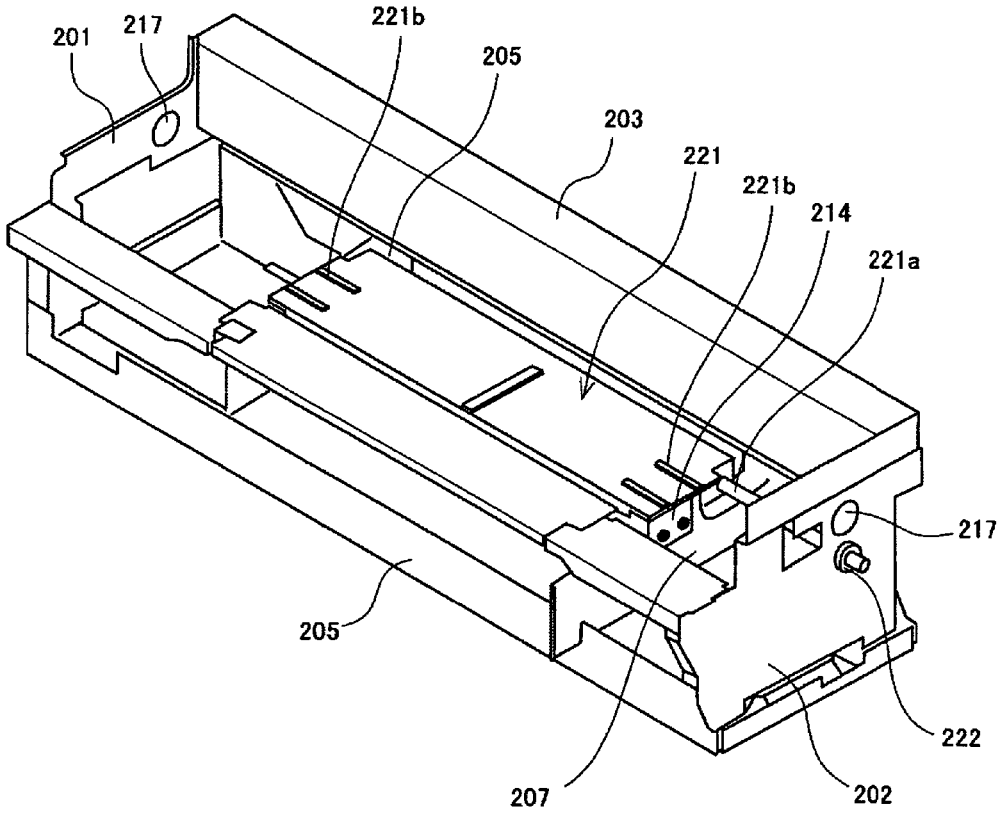
FIG. 7 is a perspective view of the image forming apparatus for explaining a position adjustment of the adjustment plate.
Figure 8:
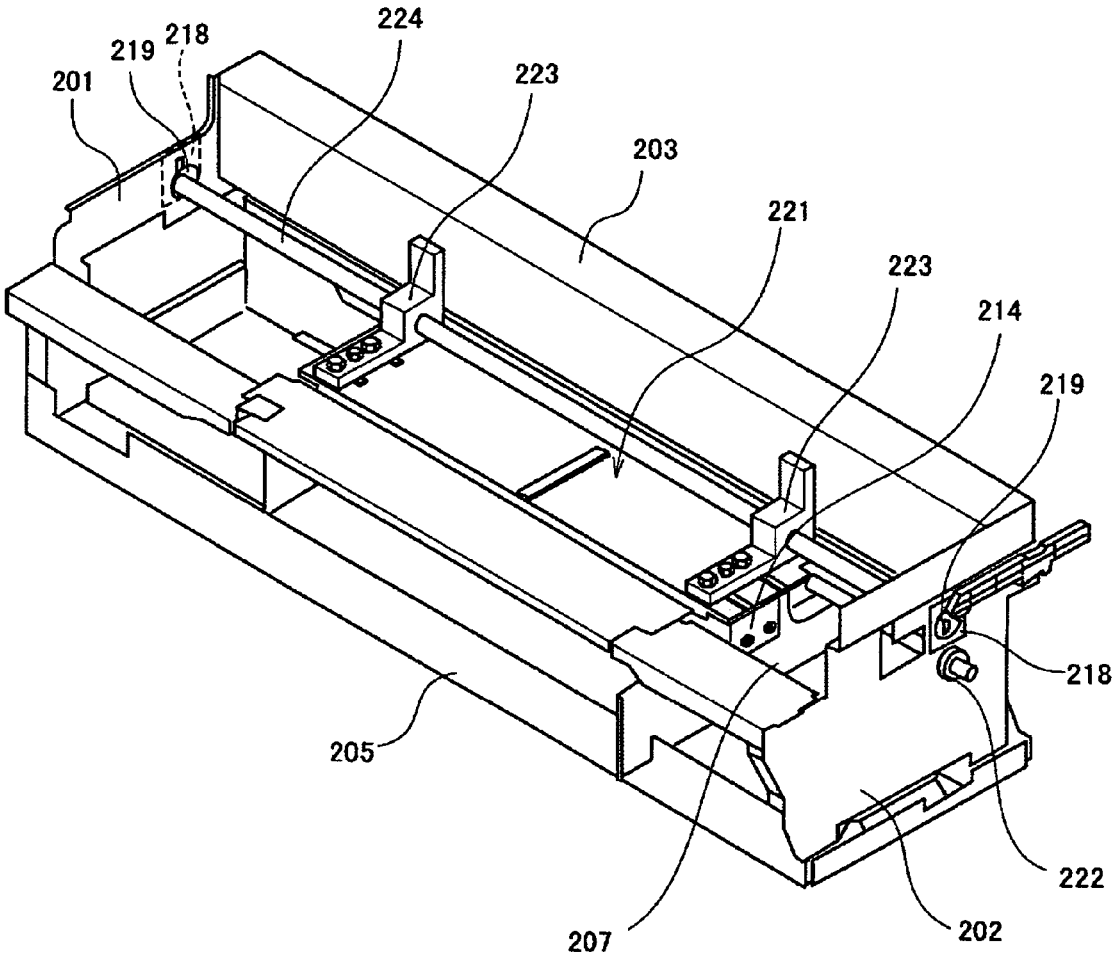
FIG. 8 is a perspective view of the image forming apparatus for explaining position adjustment of a guide rod.
Figure 9:
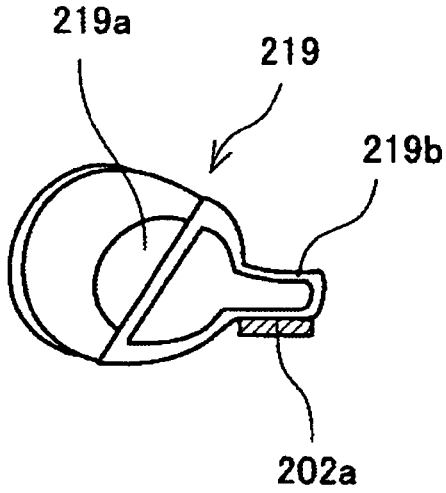
FIG. 9 is a perspective view of a rod adjustment plate.
Figure 10:
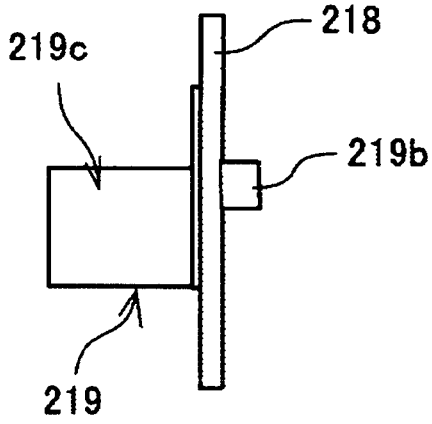
FIG. 10 is a side view of the rod adjustment plate.
Figure 11:
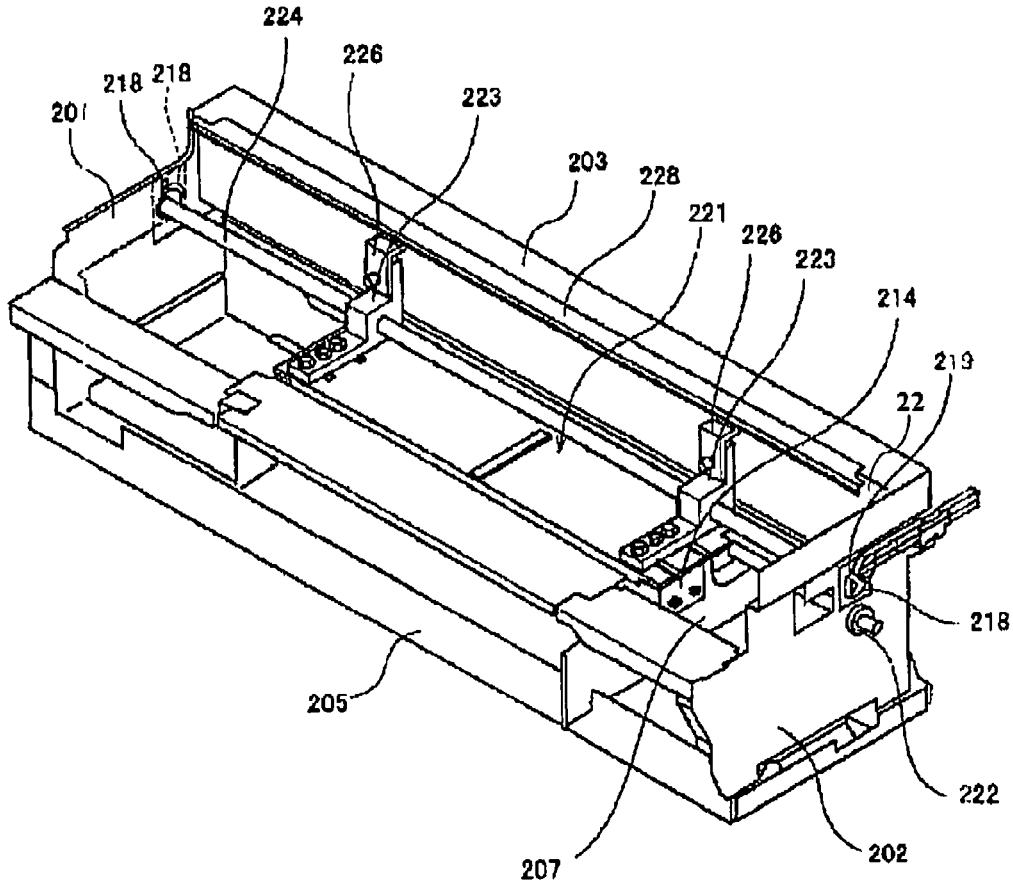
FIG. 11 is a perspective view of the image forming apparatus for explaining position adjustment of a rail adjustment plate.

Next, steps for position adjustment of the adjustment plate 214, guide rod position adjustment, and carriage fall adjustment are discussed with reference to FIG. 7 through FIG. 11. FIG. 7 is a perspective view of the image forming apparatus for explaining a position adjustment of the adjustment plate 214. FIG. 8 is a perspective view of the image forming apparatus for explaining position adjustment of a guide rod. FIG. 9 is a perspective view of a rod adjustment plate 218. FIG. 10 is a side view of the rod adjustment plate 218. FIG. 11 is a perspective view of the image forming apparatus for explaining position adjustment of a rail adjustment plate.

As shown in FIG. 7, where the adjustment plate 214 is provisionally fixed to the sub side plate 207, a plane jig 221 is supported at the supporting part 211 and the piercing hole 212 of the sub side plate 206, and the piercing hole 213 of the side plate 202 so that the plane surface state is obtained and a standard surface is determined. Here, a plane jig 221 is used for making an ideal surface, namely a standard surface corresponding to the conveyance belt unit 210. Where the plane surface of the standard surface is obtained, the arrangement position of the adjustment plate 214 against the sub side plate 207 is adjusted so that the plane surface state is maintained and the adjustment plate 214 is fixed to the sub side plate 207.

The shaft part 221*a* of the plane surface jig 221 is held at the piercing hole 212 of the sub side plate 206 and the piercing hole 213 of the side plate 202 by the bearing members 222. Under this structure, it is possible to obtain the plane surface state when the conveyance belt unit 210 is installed.

Next, as shown in FIG. 8, rod jigs 223 are arranged at corresponding positioning convex parts 221*b* provided on the plane surface jig 221 shown in FIG. 7, so that the distance between the standard surface and the guide rod 21 and positions in front and rear direction of the conveyance direction of the guide rod 21 are determined. Rod adjustment plates 218 are fixed by fixing members such as screws. By the rod adjustment plates 218, the rod member 224 corresponding to the guide rod 21 is inserted into the rod jig 223 and the position of the guide rod 21 is adjusted at the side plates 201 and 202 corresponding to the guide rod 21. As shown in FIG. 7, the piercing holes 217 are formed in the side plates 201 and 202 as corresponding to the rod adjustment plates 218. However, the configuration of the piercing holes 217 is not limited to a circular shaped configuration.

The holders 219 are rotatably supported at the rod adjustment plates 218 so as to hold corresponding ends of the rod member 224 corresponding to the guide rod 21. As shown in FIG. 9 and FIG. 10, the holder 219 forms a half moon shaped hole 219*a*, a convex part 219*b* and a receiving part 219*c*. The half moon shaped hole 219*a* hold half moon shaped parts of the corresponding ends of the guide rod 21. The convex part 219*b* is provided at an external circumferential part so as to limit a rotation position by engaging with a stopping piece 202*a* formed in the side plate 202. The receiving part 219*c* is provided at an inside part 202*a* of the side plate 202 so as to receive an end of the guide rod 21. The height of the guide rod 21 is adjusted by rotating the holder 219 so that the distance between the recording head 24 and the paper, that is a paper gap, is adjusted.

After that, as shown in FIG. 11, the guide rail 22 is positioned at the rod jigs 223. The rail adjustment jigs 226 are arranged so as to adjust the fall (vertical position) of the carriage 23. The rail jig 228 is arranged at the front plate 203. The position of the rail jig 228 is adjusted so as to prevent the fall in front and rear direction, that is, the paper conveyance direction, of the carriage 23.

Thus, the adjustment plate 214 configured to adjust the arrangement position of the conveyance belt unit 210, the rod adjustment plates 218 and holders 219 configured to adjust the position of the guide rod 21 against the standard surface, the rail adjustment jig 226 configured to adjust the position of the guide rail 22 against the position of the guide rod 21, that is the fall of the carriage 23, and the rail jig 228, are adjusted and arranged in turn, so that positioning of respective parts is accomplished. As a result of this, it is possible to arrange these parts at the frame at high precision.

The present invention is not limited to the above-discussed embodiments, but variations and modifications may be made without departing from the scope of the present invention.

This patent application is based on Japanese Priority Patent Application No. 2004-367776 filed on Dec. 20, 2004, the entire contents of which are hereby incorporated by reference.

What is claimed is:

1. An image forming apparatus, comprising:

a carriage where a recording head configured to jet a liquid drop of recording liquid is provided;

a conveyance belt unit including a conveyance belt configured to convey a recording medium; and a frame member in a main body of the image forming apparatus, said frame member including side plates and an adjustment plate for adjustment of an arrangement position of the conveyance belt unit relative to the frame member of the image forming apparatus, wherein the carriage is moved in a main scanning direction along a guide member and the recording medium is sent in a sub-scanning direction by the conveyance belt so that an image is formed on the recording medium, and wherein the conveyance belt unit is configured to be detachable from said frame member of the image forming apparatus, the conveyance belt unit is supported at four points of the frame member of the image forming apparatus, three points of the four points are supported by said side plates of the frame member of the image forming apparatus, and one point of the four points is supported by the adjustment plate of the frame member of the image forming apparatus.

2. The image forming apparatus as claimed in claim 1, wherein another adjustment plate configured to adjust a position of the guide member configured to guide the moving in the main scanning direction of the carriage is provided at another frame member where the guide member is arranged.

3. The image forming apparatus as claimed in claim 1, wherein the side plates and adjustment plate form a part of said frame member, and said frame member is a part of a main body of the image forming apparatus.

4. An image forming apparatus, comprising:

a carriage where a recording head configured to jet a liquid drop of recording liquid is provided;

a conveyance belt unit including a conveyance belt configured to convey a recording medium; and a frame member in a main body of the image forming apparatus, said frame member including side plates and adjustment means for adjustment of an arrangement position of the conveyance belt unit relative to the frame member of the image forming apparatus, wherein the carriage is moved in a main scanning direction along a guide member and the recording medium is sent in a sub-scanning direction by the conveyance belt so that an image is formed on the recording medium, and wherein the conveyance belt unit is configured to be detachable from said frame member of the image forming apparatus, the conveyance belt unit is supported at four points of the frame member of the image forming apparatus, three points of the four points are supported by said side plates of the frame member of the image forming apparatus, and one point of the four points is supported by the adjustment means of the frame member of the image forming apparatus.

5. The image forming apparatus as claimed in claim 4, wherein the means for adjusting a position of the guide member configured to guide the moving in the main scanning direction of the carriage is provided at another frame member where the guide member is arranged.

6. An adjusting method of an image forming apparatus that includes a carriage where a recording head configured to jet a liquid drop of recording liquid is provided, a conveyance belt unit including a conveyance belt configured to convey a recording medium, and a frame member in a main body of the image forming apparatus, said frame member including side plates and an adjustment plate for adjustment of an arrangement position of the conveyance belt unit relative to the frame member of the image forming apparatus, wherein the carriage is moved in a main scanning direction along a guide member and the recording medium is sent in a sub-scanning direction by the conveyance belt so that an image is formed on the recording medium;

the method comprising:

supporting the conveyance belt unit at four points of the frame member of the image forming apparatus;

supporting three points of the four points by said side plates of the frame member of the image forming apparatus;

supporting one point of the four points by the adjustment plate of the frame member of the image forming apparatus; and adjusting the arrangement position of the adjustment plate against the frame member of the image forming apparatus, by using a plane jig configured to form a standard plane surface.

7. The adjusting method of the image forming apparatus as claimed in claim 6, further comprising the steps of:

mounting a rod positioning jig on the plane jig, the rod positioning jig being configured to determine a height position of a guide rod configured to guide the moving in the main scanning direction of the carriage; and adjusting the arrangement position of the adjustment plate against the frame member by inserting the guide rod or a guide rod jig into the rod positioning jig.

8. The adjusting method of the image forming apparatus as claimed in claim 7, further comprising the steps of:

arranging a rail positioning jig configured to determine an arrangement position of a guide rail configured to guide the moving in the main scanning direction of the carriage, at the rod positioning jig; and arranging a rail jig corresponding to the guide rail by corresponding to the rail positioning jig and thereby fall of the carriage is adjusted.

* * * * *